US008439003B2

(12) United States Patent
Araki et al.

(10) Patent No.: US 8,439,003 B2
(45) Date of Patent: May 14, 2013

(54) COOLING APPARATUS FOR INTERNAL COMBUSTION ENGINE, METHOD OF CONTROLLING THE SAME, AND HYBRID VEHICLE INCLUDING THE SAME

(75) Inventors: Yukari Araki, Chiryu (JP); Nobutaka Takeuchi, Nishikamo-gun (JP); Osamu Shintani, Toyota (JP); Kazuya Nakagaki, Toyota (JP); Daisuke Murakami, Toyota (JP); Masanori Shibata, Toyota (JP); Hisao Nonoyama, Kariya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 481 days.

(21) Appl. No.: 12/434,825

(22) Filed: May 4, 2009

(65) Prior Publication Data

US 2010/0050960 A1 Mar. 4, 2010

(30) Foreign Application Priority Data

Sep. 4, 2008 (JP) ..... 2008-227138

(51) Int. Cl.
*F01P 7/14* (2006.01)

(52) U.S. Cl.
USPC ..... 123/41.1; 123/41.21; 123/41.44

(58) Field of Classification Search ..... 123/41.1, 123/41.01, 41.14, 41.54, 142.5 R, 41.21, 123/41.44
See application file for complete search history.

(56) References Cited

U.S. PATENT DOCUMENTS 4,367,699 A * 1/1983 Evans ..... 123/41.23
4,545,335 A * 10/1985 Hayashi ..... 123/41.27
5,031,579 A * 7/1991 Evans ..... 123/41.2
6,213,233 B1 * 4/2001 Sonntag et al. ..... 180/65.245
6,532,911 B2 * 3/2003 Suzuki et al. ..... 123/41.14
6,928,962 B2 * 8/2005 Yamazaki ..... 123/41.05
7,140,330 B2 * 11/2006 Rogers et al. ..... 123/41.14
2002/0022769 A1 * 2/2002 Smith et al. ..... 600/188
2005/0022769 A1 * 2/2005 Kuze et al. ..... 123/142.5 R
2009/0145375 A1 * 6/2009 Kaita et al. ..... 123/41.02

FOREIGN PATENT DOCUMENTS

JP 2005-57953 3/2005
JP 2007-218115 8/2007
JP 2008-121434 5/2008
JP 2008-184996 8/2008

OTHER PUBLICATIONS

Japanese Office Action drafted Jun. 15, 2010, in Patent Application No. 2008-227138 (with English-language translation).

* cited by examiner

*Primary Examiner* — Noah Kamen
*Assistant Examiner* — Long T Tran
(74) *Attorney, Agent, or Firm* — Oblon, Spivak, McClelland, Maier & Neustadt, L.L.P.

(57) ABSTRACT

A cooling apparatus for an internal combustion engine includes an engine cooling system that includes a water jacket, a radiator, and a circulation passage through which a coolant is circulated between the water jacket and the radiator, wherein the coolant is provided in the engine cooling system; a water pump that forcibly circulates the coolant provided in the engine cooling system when the water pump is operated; a reservoir tank in which the coolant is reserved, and into which gas flows from the engine cooling system while the reserved coolant flows out to the engine cooling system from the reservoir tank; and a forcible introduction portion that forcibly introduces the coolant from the reservoir tank into the engine cooling system before the internal combustion engine is started.

18 Claims, 4 Drawing Sheets

COOLING APPARATUS FOR INTERNAL COMBUSTION ENGINE, METHOD OF CONTROLLING THE SAME, AND HYBRID VEHICLE INCLUDING THE SAME

INCORPORATION BY REFERENCE

The disclosure of Japanese Patent Application No. 2008-227138 filed on Sep. 4, 2008 including the specification, drawings and abstract is incorporated herein by reference in its entirety.

BACKGROUND OF THE INVENTION

1. Field of the Invention

The invention relates to a cooling apparatus for an internal combustion engine, in which a coolant is circulated in an engine cooling system by operating a water pump, a method of controlling the cooling apparatus, and a hybrid vehicle including the cooling apparatus.

2. Description of the Related Art

A cooling apparatus for an internal combustion engine generally includes an engine cooling system that includes a water jacket formed in the engine, a radiator that is a heat exchanger, and a circulation passage that connects the water jacket and the radiator (for example, refer to Japanese Patent Application Publication No. 2007-218115 (JP-A-2007-218115)). The cooling apparatus for an internal combustion engine also includes a water pump that pressurizes and delivers a coolant with which the engine cooling system is filled. The coolant is forcibly circulated in the engine cooling system, and thus, the internal combustion engine is cooled, by operating the water pump.

For example, in the case where the internal combustion engine is assembled or the coolant is changed, when the coolant is supplied into the engine cooling system, an operation for removing air that has entered the engine cooling system (so-called an air bleeding operation) may not be sufficiently performed. In such a case, there may be air in the engine cooling system, and accordingly, a delivery capacity of the water pump may be decreased.

Particularly, when there is a large amount of gas in the engine cooling system, the delivery capacity of the water pump is greatly decreased. Therefore, the coolant may not be appropriately circulated in the engine cooling system. In some cases, the internal combustion engine may be overheated due to a decrease in cooling performance caused by an insufficient amount of the coolant delivered by the water pump.

SUMMARY OF THE INVENTION

The invention provides a cooling apparatus for an internal combustion engine, which suppresses a decrease in cooling performance due to gas that has entered an engine cooling system, a method of controlling the cooling apparatus, and a hybrid vehicle including the cooling apparatus.

A first aspect of the invention relates to a cooling apparatus for an internal combustion engine. The cooling apparatus includes an engine cooling system that includes a water jacket, a radiator, and a circulation passage through which a coolant is circulated between the water jacket and the radiator, wherein the coolant is provided in the engine cooling system; a water pump that forcibly circulates the coolant provided in the engine cooling system when the water pump is operated; a reservoir tank in which the coolant is reserved, and into which gas flows from the engine cooling system while the reserved coolant flows out to the engine cooling system from the reservoir tank; and a forcible introduction portion that forcibly introduces the coolant from the reservoir tank into the engine cooling system before the internal combustion engine is started.

With the above-described configuration, the coolant is forcibly introduced from the reservoir tank into the engine cooling system before the internal combustion engine is started. Thus, it is possible to remove the gas from the engine cooling system by causing the gas to flow into the reservoir tank. Accordingly, the operation of the internal combustion engine and the cooling of the internal combustion engine using the coolant are started after the amount of the gas in the engine cooling system is reduced. This makes it possible to suppress a decrease in cooling performance due to the gas that has entered the engine cooling system.

In the cooling apparatus according to the above-described aspect, when the gas reaches a specific portion of the engine cooling system, the gas may flow into the reservoir tank while the coolant flows out from the reservoir tank; and the forcible introduction portion may circulate the coolant by operating the water pump in a manner such that an amount of the coolant circulated in the engine cooling system is increased and decreased.

With the above-described configuration, when the amount of the circulated coolant is large, the gas mixed in the coolant moves to an intake side of the water pump together with the coolant. When the amount of the circulated coolant is small, the gas moves upward in a vertical direction in the engine cooling system due to a buoyant force. Thus, the gas flows in the engine cooling system without gathering in a location where the water pump is disposed. Thus, the gas in the engine cooling system moves to a specific portion that allows the gas to flow into the engine cooling system. This makes it possible to remove the gas from the engine cooling system.

In the cooling apparatus according to the above-described aspect, the water pump may be an electric water pump; and the forcible introduction portion may intermittently operate the water pump.

With the above-described configuration, when the water pump is operated, the gas mixed in the coolant moves to the intake side of the water pump. When the operation of the water pump is stopped, the gas moves upward in the vertical direction in the engine cooling system due to the buoyant force. Thus, it is possible to move the gas in the engine cooling system.

In the cooling apparatus according to the above-described aspect, the engine cooling system may further include a detour which bypasses the radiator, and through which the coolant in the circulation passage is returned into the water jacket.

In the above-described configuration, because the detour is provided, the integrated length of passages, through which the coolant flows in the engine cooling system, is long as compared to the configuration where the detour is not provided. Therefore, the amount of the gas mixed into the coolant in the engine cooling system is likely to be large, and accordingly, the cooling performance is likely to be decreased.

With the above-described configuration, in the above-described cooling apparatus where the detour is provided, it is possible to suppress a decrease in the cooling performance due to the gas that has entered the engine cooling system.

In the cooling apparatus according to the above-described aspect, a heater core of a heater unit may be provided in the detour.

The heater core, which is the heat exchanger of the heater unit, is usually provided at a position distant from the internal combustion engine. For example, the heater core is usually provided in a vehicle cabin. Therefore, the detour, in which the heater core is provided, is likely to be long, and the total amount of the gas that enters the detour is likely to be large. Accordingly, in the above-described configuration in which the heater core is used in the detour, the amount of the gas mixed into the coolant in the engine cooling system is likely to be large, and the cooling performance is likely to be decreased.

With the above-described configuration, in the above-described cooling apparatus where the heater core is provided in the detour, it is possible to suppress a decrease in the cooling performance due to the gas that has entered the engine cooling system. The cooling apparatus according to the above-described aspect may further include a thermostat valve provided in the circulation passage, wherein when a temperature of the coolant that contacts the thermostat valve is lower than a threshold value, the thermostat valve is closed to prohibit the coolant from flowing into the radiator, and when the temperature of the coolant that contacts the thermostat valve is equal to or higher than the threshold value, the thermostat valve is opened to permit the coolant to flow into the radiator; and a jiggle valve provided in the thermostat valve. The detour may bypass the thermostat valve; and the reservoir tank may be disposed in a manner such that the coolant, which flows out from the reservoir tank, flows into the water pump through the thermostat valve.

In the above-described configuration, the coolant, which flows out from the reservoir tank, flows into the water pump through the thermostat valve. Therefore, when the coolant is forcibly introduced into the engine cooling system while the thermostat valve is closed, the thermostat valve may interfere with the introduction of the coolant into the engine cooling system. However, in the above-described configuration, the jiggle valve is provided in the thermostat valve. When the difference between a pressure in an area upstream of the thermostat valve in a direction in which the coolant flows and a pressure in an area downstream of the thermostat valve in the direction in which the coolant flows is small, the jiggle valve is opened to provide communication between the area upstream of the thermostat valve and the area downstream of the thermostat valve. When the difference between the pressure in the area upstream of the thermostat valve and the pressure in the area downstream of the thermostat valve is large, the jiggle valve is closed to interrupt the communication between the area upstream of the thermostat valve and the area downstream of the thermostat valve.

Thus, with the above-described configuration, even if the temperature of the coolant is low, and accordingly the thermostat valve is closed when the coolant is forcibly introduced into the engine cooling system, it is possible to introduce the coolant from the reservoir tank into the engine cooling system using the jiggle valve, by decreasing the above-described pressure difference, thereby opening the jiggle valve.

In the cooling apparatus according to the above-described aspect, the forcible introduction portion may forcibly introduce the coolant into the engine cooling system only once, each time a storage battery, which has been disconnected from an electric circuit that supplies electric power to the internal combustion engine and peripheral equipment for the internal combustion engine, is connected to the electric circuit.

In the apparatus where the coolant is provided in the engine cooling system, when the coolant is supplied into the engine cooling system, gas is likely to enter the engine cooling system, and the amount of the gas that enters the engine cooling system is likely to increase. The operation for supplying the coolant into the engine cooling system is generally performed while the electric circuit that supplies electric power to the internal combustion engine and peripheral equipment for the internal combustion engine is disconnected from the storage battery. Therefore, when the storage battery, which has been disconnected from the electric circuit that supplies the electric power to the internal combustion engine and the peripheral equipment for the internal combustion engine, is connected to the electric circuit, there is a possibility that the operation for supplying the coolant into the engine cooling system has been performed. Thus, there is a possibility that the amount of the gas in the engine cooling system has increased.

With the above-described configuration, the coolant is forcibly introduced into the engine cooling system to reduce the amount of the gas in the engine cooling system, only when there is a possibility that the operation for supplying the coolant into the engine cooling system has been performed. Thus, it is possible to efficiently reduce the amount of the gas in the engine cooling system, and accordingly, to appropriately suppress a decrease in the cooling performance.

A hybrid vehicle, which includes the internal combustion engine and a motor that function as power sources, may include the cooling apparatus according to the above-described aspect.

When the above-described hybrid vehicle is stopped, operation of the internal combustion engine and operation of the motor are stopped. When the hybrid vehicle starts moving or travels at a low speed, the operation of the internal combustion engine is stopped, and the motor is operated. Unless the hybrid vehicle is stopped, or the hybrid vehicle starts moving or travels at a low speed, the internal combustion engine is operated. In contrast, in a vehicle in which only the internal combustion engine is provided as a power source, the internal combustion engine is constantly operated when the vehicle travels. Therefore, in the hybrid vehicle, a period from when the vehicle is activated until when the internal combustion engine is started tends to be long, as compared to the vehicle in which only the internal combustion engine is provided. Accordingly, it is possible to take a long time to forcibly introduce the coolant into the engine cooling system before the internal combustion engine is started.

Thus, with the above-described configuration, it is possible to forcibly introduce the coolant into the engine cooling system for a long period before the internal combustion engine is started. This makes it possible to sufficiently reduce the amount of the gas in the engine cooling system.

A second aspect of the invention relates to a method of controlling a cooling apparatus for an internal combustion engine. The cooling apparatus includes an engine cooling system that includes a water jacket, a radiator, and a circulation passage through which a coolant is circulated between the water jacket and the radiator, wherein the coolant is provided in the engine cooling system; a water pump that forcibly circulates the coolant provided in the engine cooling system when the water pump is operated; and a reservoir tank in which the coolant is reserved, and into which gas flows from the engine cooling system while the reserved coolant flows out to the engine cooling system from the reservoir tank. The method includes determining whether a predetermined condition is satisfied before the internal combustion engine is started; starting intermittent operation of the water pump to forcibly introduce the coolant from the reservoir tank into the engine cooling system, when the predetermined condition is satisfied; and stopping the intermittent operation of the water pump, when the predetermined condition is unsatisfied.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Embodiment

Hereinafter, a cooling apparatus for an internal combustion engine according to an embodiment of the invention will be described. First, a schematic configuration of a vehicle, to which a cooling apparatus for an internal combustion engine according to the embodiment is applied, will be described with reference to FIG. 1.

Figure 1:
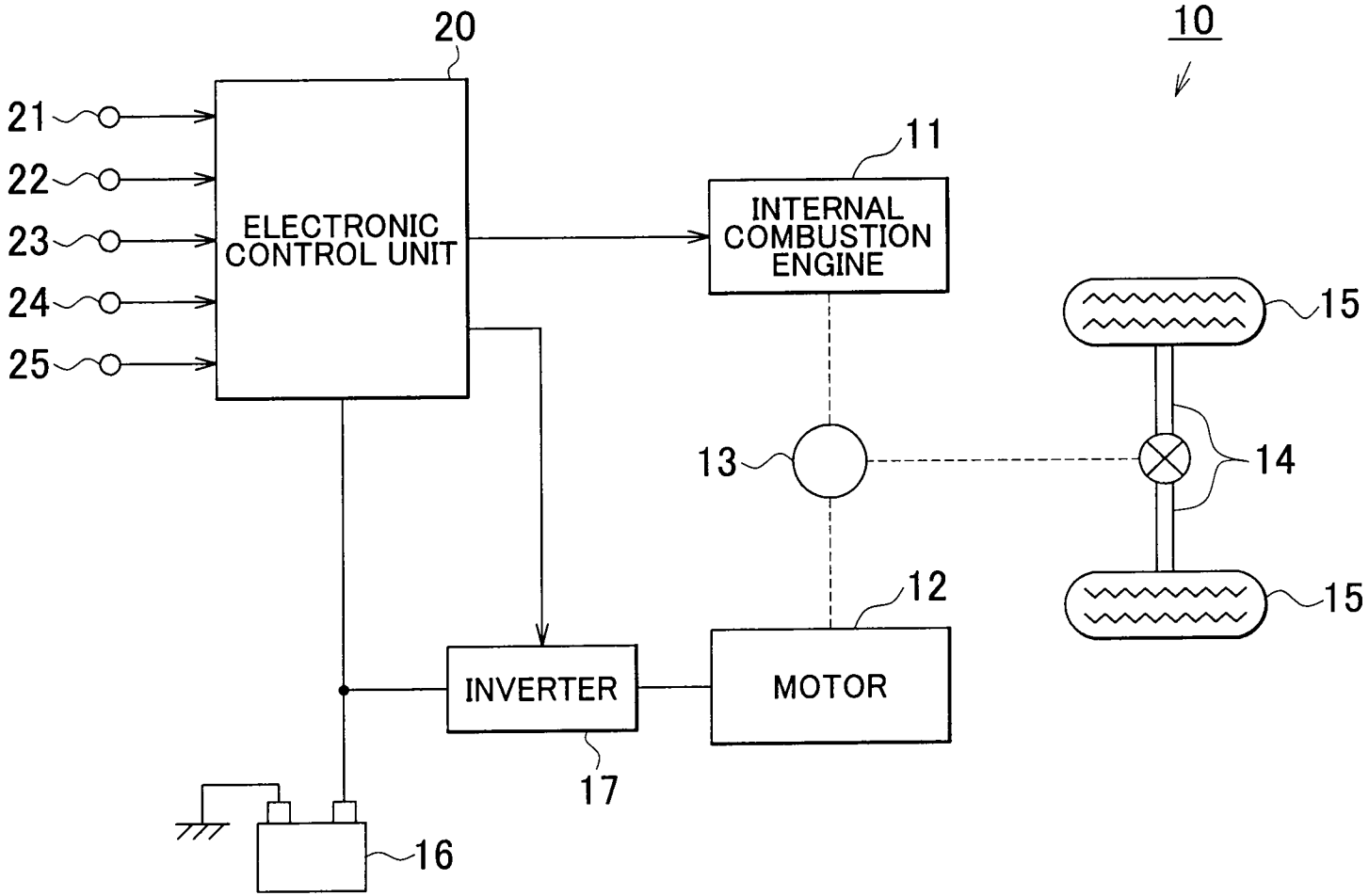
FIG. 1 is a block diagram showing a schematic configuration of a vehicle to which an embodiment of the invention is applied.

As shown in FIG. 1, a vehicle 10 is a so-called hybrid vehicle in which an internal combustion engine 11 and a motor 12 are provided as power sources. An output shaft (not shown) of the internal combustion engine 11 and an output shaft (not shown) of the motor 12 are connected to an axle 14 and drive wheels 15 through a power split mechanism 13. Drive power output from the internal combustion engine 11 and drive power output from the motor are transmitted to the drive wheels 15 through the power split mechanism 13.

The internal combustion engine 11 generates drive power by burning fuel. The drive power generated by the internal combustion engine 11 is adjusted by adjusting an intake air amount and a fuel injection amount. The motor 12 generates the drive power using electric power supplied from a storage battery 16. The motor 12 is connected to the storage battery 16 through an inverter 17. The amount of electric power supplied to the motor 12 from the storage battery 16 is adjusted by controlling the operation of the inverter 17. Thus, the drive power generated by the motor 12 is adjusted.

The vehicle 10 is provided with sensors used to determine the operating state of the vehicle 10. More specifically, the vehicle 10 is provided with a vehicle-speed sensor 21 that detects a travel speed (a vehicle speed SPD) of the vehicle 10, and an operation switch 22 that changes the state of the vehicle 10 between an operated state and a stopped state. Also, the vehicle 10 is provided with a crank sensor 23 that detects the rotational speed of the output shaft of the internal combustion engine 11 (i.e., the engine speed NE), a coolant temperature sensor 24 that detects the temperature of an engine coolant (i.e., a coolant temperature THW), and an outside air temperature sensor 25 that detects the temperature of outside air (i.e., an outside air temperature THA).

Also, the vehicle 10 is provided with an electronic control unit 20 that includes a microcomputer. The electronic control unit 20 receives signals output from the sensors, and determines the operating state of the vehicle 10 based on the signals output from the sensors. The electronic control unit 20 executes a control of the operation of the internal combustion engine 11, such as a control that adjusts the intake air amount and the fuel injection amount, and a control of the operation of the motor 12 (more specifically, a control of the operation of the inverter 17).

In the embodiment, the control of the operation of the vehicle 10 is basically executed in the following manner. That is, when the vehicle 10 is stopped, the operation of the internal combustion engine 11 is stopped to reduce the amount of fuel consumed in the internal combustion engine 11, and the operation of the motor 12 is stopped. When the vehicle 10 starts moving or the vehicle 10 travels at a low speed, the operation efficiency of the internal combustion engine is low (i.e., the amount of the generated drive power with respect to the amount of the consumed fuel is small), and therefore, the motor 12 is operated while the operation of the internal combustion engine 11 is stopped. Further, unless the vehicle starts moving or the vehicle travels at a low speed, the operation efficiency of the internal combustion engine 11 is high, and therefore, the internal combustion engine 11 is operated.

Figure 2:
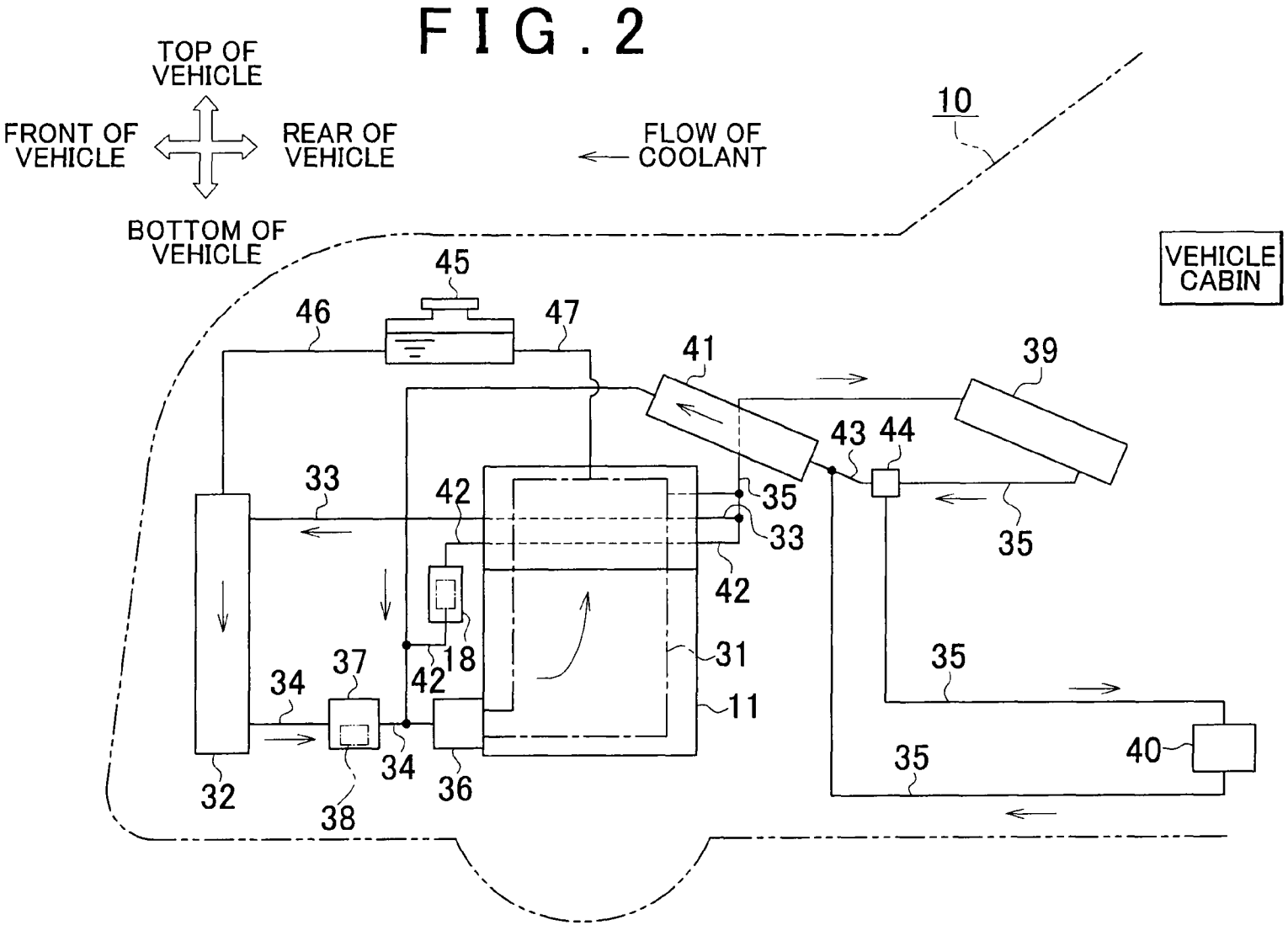
FIG. 2 is a diagram showing a schematic configuration of a cooling apparatus for an internal combustion engine according to the embodiment of the invention.

Next, a cooling apparatus that cools the internal combustion engine 11 will be described with reference to FIG. 2. As shown in FIG. 2, a water jacket 31 is formed in the internal combustion engine 11. A radiator 32 is provided in the vehicle 10. The water jacket 31 and the radiator 32 are connected to each other through circulation passages 33 and 34. The coolant is supplied from the water jacket 31 to the radiator 32 through the circulation passage 33. After the coolant is cooled by the radiator 32, the coolant is returned to the water jacket 31 through the circulation passage 34. In the embodiment, an engine cooling system includes the water jacket 31, the radiator 32, the circulation passages 33 and 34, a detour 35, and a throttle passage 42 (the detour 35 and the throttle passage 42 will be described later). The coolant is provided in the engine cooling system.

The circulation passage 34 is connected to the water jacket 31 through an electric water pump 36. The coolant in the circulation passage 34 is forcibly returned to the water jacket 31 by operating the water pump 36. Thus, the coolant is forcibly circulated in the engine cooling system.

In the embodiment, when the operation of the water pump 36 is controlled, the electronic control unit 20 controls the electric power supplied to the water pump 36 by adjusting a duty ratio. More specifically, the electronic control unit 20 adjusts a ratio between a time during which the electric power is supplied to the water pump 36 and a time during which the electric power is not supplied to the water pump 36, in an extremely short predetermined unit time. As the duty ratio increases, the amount of the electric power supplied to the water pump 36 increases, and the amount of the coolant delivered by the water pump 36 increases.

When the water pump 36 is normally operated (i.e., unless the water pump 36 is intermittently operated as described later), the operation of the water pump 36 is controlled based on the following concept. Basically, as the engine speed NE increases, the duty ratio is set to increase to increase the amount of the delivered coolant. Also, when cooling performance required of the cooling apparatus is low, for example, when the temperature of the coolant that is circulated in the engine cooling system (more specifically, the coolant temperature THW) is low, or when the outside air has a high effect of cooling the coolant, for example, when the outside air temperature THA is low, the duty ratio is set to a low value, to reduce the possibility that the water pump 36 is unnecessarily operated.

A thermostat valve 37 is provided in the circulation passage 34. An amount, by which the thermostat valve 37 is opened, is changed according to the temperature of the coolant that contacts the thermostat valve 37. The flow rate of the coolant that passes through the radiator 32 is adjusted by opening/closing the thermostat valve 37. Basically, when the temperature of the coolant that contacts the thermostat valve 37 is lower than a threshold value, the thermostat valve 37 is closed to prohibit the coolant from flowing from the circulation passage 33 to the radiator 32, and when the temperature of the coolant that contacts the thermostat valve 37 is equal to or higher than the threshold value, the thermostat valve 37 is opened to permit the coolant to flow from the circulation passage 33 into the radiator 32.

A jiggle valve 38 is provided in the thermostat valve 37. The jiggle valve 38 permits gas mixed in the coolant or a small amount of the coolant to pass through the jiggle valve 38. When the difference between a pressure in an area upstream of the thermostat valve 37 in a direction in which the coolant flows (hereinafter, simply referred to as "area upstream of the thermostat valve 37") and a pressure in an area downstream of the thermostat valve 37 in the direction in which the coolant flows (hereinafter, simply referred to as "area downstream of the thermostat valve 37") is small, the jiggle valve 38 is opened. When the difference between the pressure in the area upstream of the thermostat valve 37 and the pressure in the area downstream of the thermostat valve 37 is large, the jiggle valve 38 is closed. When the jiggle valve 38 is opened, communication is provided between the area upstream of the thermostat valve 37 and the area downstream of the thermostat valve 37. When the jiggle valve 38 is closed, the communication between the area upstream of the thermostat valve 37 and the area downstream of the thermostat valve 37 is interrupted.

In the cooling apparatus according to the embodiment, the detour 35 is provided. The detour 35 bypasses the radiator 32 and the thermostat 37, and connects the circulation passages 33 and 34. After the water pump 36 pressurizes and delivers the coolant, the coolant passes through the water jacket 31, and is discharged to the circulation passage 33. Then, the coolant is returned into the water jacket 31 through the detour 35 without passing through the radiator 32 and the thermostat valve 37.

A heater core 39 of a heater unit, an exhaust heat recovery unit 40, and an EGR cooler 41 are provided in the detour 35. The heater core 39 is a heat exchanger. Heat is exchanged between an atmosphere (i.e., air delivered by a heater blower (not shown)) around the heater core 39 and the coolant that passes through the heater core 39. The air warmed by the heater core 39 is introduced into a vehicle cabin, and accordingly, the vehicle cabin is warmed. In the embodiment, the heater core 39 is provided in the vehicle cabin.

The exhaust heat recovery unit 40 is a heat exchanger that warms the coolant using the heat of the exhaust gas discharged from the internal combustion engine 11. In the detour 35, a bypass passage 43 and a switch valve 44 are provided. The bypass passage 43 bypasses the exhaust heat recovery unit 40. When the temperature of the coolant is low (for example, when the cold internal combustion engine 11 is started), the switching valve 44 allows the coolant to pass through the exhaust heat recovery unit 40 to quickly warm up the internal combustion engine 1. When the temperature of the coolant is high (for example, after the warming-up of the internal combustion engine 11 is completed), the switching valve 44 prevents the coolant from passing through the exhaust heat recovery unit 40, and allows the coolant to pass through the bypass passage 43. In the embodiment, the exhaust heat recovery unit 40 is provided in a lower portion of the vehicle 10. The electronic control unit 20 controls the operation of the switching valve 44.

In the EGR cooler 41, heat is exchanged between the coolant passing through the EGR cooler 41 and exhaust gas (so-called EGR gas) returned from an exhaust passage (not shown) to an intake passage (not shown) so that the EGR gas is cooled.

Further, the throttle passage 42 is provided in the cooling apparatus according to the embodiment. The throttle passage 42 bypasses the radiator 32 and the thermostat 37, and connects the circulation passages 33 and 34, as well as the detour 35. After the water pump 36 pressurizes and delivers the coolant, the coolant passes through the water jacket 31, and is discharged to the circulation passage 33. Part of the coolant discharged to the circulation passage 33 is returned into the water jacket 31 through the throttle passage 42, without passing through the radiator 32 and the thermostat valve 37. The throttle passage 42 extends to pass through a throttle body 18 provided in the intake passage for the internal combustion engine 11. In the throttle passage 42, heat is exchanged between the coolant passing through the throttle passage 42 and the throttle body 18.

A reservoir tank 45 is provided in the cooling apparatus according to the embodiment. The coolant is stored in the reservoir tank 45. The reservoir tank 45 is connected to an upstream portion of the radiator 32 (more specifically, an upper portion of the radiator 32 in the vehicle 10) through an outflow passage 46. The reservoir tank 45 is connected to an upper portion of the water jacket 31 (more specifically, a portion of the water jacket 31, which is formed in a cylinder head of the internal combustion engine 11) through an inflow passage 47. The reservoir tank 45 is disposed so that a surface of the coolant stored in the reservoir tank 45 is positioned above the water jacket 31, the radiator 32, and the circulation passages 33 and 34 in a vertical direction.

When the volume of the coolant expands due to an increase in the temperature of the coolant, a portion of the coolant, whose volume is equivalent to an increment in the volume, is temporarily stored in the reservoir tank 45. In addition, in the reservoir tank 45, the gas mixed in the coolant (for example, air that enters the engine cooling system when the coolant is supplied into the engine cooling system, and the coolant vaporized in the engine cooling system) is separated from the coolant. When the gas is mixed into the coolant, the gas moves due to the operation of the water pump 36. When the gas reaches the upper portion (specific portion) of the water jacket 31 in the vehicle 10, the gas flows into the reservoir tank 45 through the inflow passage 47. Accordingly, the coolant in the reservoir tank 45 flows into the engine cooling system through the outflow passage 46.

In the cooling apparatus according to the embodiment, the inside of the engine cooling system, which includes the water jacket 31, the radiator 32, the circulation passages 33 and 34, the detour 35, and the throttle passage 42, is sealed. Also, the inside of the reservoir tank 45, the inside of the outflow passage 46, and the inside of the inflow passage 47 are sealed. The reservoir tank 45, the outflow passage 46, and the inflow passage 47 are connected to the engine cooling system.

When there is gas inside the engine cooling system, for example, because air is mixed into the coolant when the coolant is supplied into the engine cooling system, the delivery capacity of the water pump 36 may be decreased. Particularly, when there is a large amount of gas inside the engine cooling system, the delivery capacity of the water pump 36 is greatly decreased. Therefore, the coolant may not be appropriately circulated in the engine cooling system. Thus, in some cases, the internal combustion engine 11 may be overheated.

Also, in the embodiment, because the detour 35 is provided in the engine cooling system, the integrated length of the passages, through which the coolant flows in the engine cooling system, is long, and therefore, the amount of the gas that enters the engine cooling system is likely to be large, as compared to the cooling apparatus in which the detour 35 is not provided. Further, the heater core 39 and the exhaust heat recovery unit 40 are provided in the detour 35. The heater core 39 is provided in the vehicle cabin, and the exhaust heat recovery unit 40 is provided in the lower portion of the vehicle 10. That is, the heater core 39 and the exhaust heat recovery unit 40 are provided far from the internal combustion engine 11. Thus, in the cooling apparatus according to the embodiment, the detour 35 is long, and therefore, the total amount of the gas that enters the detour 35 is likely to be large, as compared to a cooling apparatus where the heat core 39 and the exhaust heat recovery unit 40 are not provided.

Further, in the embodiment, the water pump 36 is a rotary water pump in which a bearing for a rotational shaft is lubricated by the coolant that passes through the water pump 36. Therefore, if there is a large amount of gas inside the engine cooling system, and the gas is taken into, and gathered into the water pump 36, the amount of the coolant supplied to the bearing is insufficient, and the bearing is not appropriately lubricated. In some cases, the rotational shaft of the water pump 36 may be seized in the bearing.

In view of this, in the embodiment, the water pump 36 is intermittently operated after the driver operates the operation switch 22, and accordingly the vehicle 10 is activated, and before the operation of the internal combustion engine 11 is started.

If the water pump 36 is continuously operated while there is air in the engine cooling system, the air gathers into the water pump 36. In contrast, in the case where the water pump 36 is intermittently operated as in the embodiment, the gas mixed in the coolant moves to an intake side of the water pump 36 when the water pump 36 is operated, as in the case where the water pump 36 is continuously operated. However, when the operation of the water pump 36 is stopped, the gas mixed in the coolant moves upward toward an upper portion of the engine cooling system in the vertical direction, due to a buoyant force. Therefore, the gas, which is taken into the water pump 36 when the water pump 36 is operated, moves out from the water pump 36, and then, moves upward in the water jacket 31. Accordingly, the gas reaches the upper portion of the water jacket 31, that is, the specific portion of the water jacket 31, which allows the gas to flow into the reservoir tank 45.

Because the water pump 36 is thus intermittently operated, the gas that has entered the engine cooling system flows in the engine cooling system, and reaches the specific portion, without gathering in the location where the water pump 36 is disposed. Thus, the gas, which has reached the specific portion, flows into the reservoir tank 45 through the inflow passage 47. Accordingly, the coolant flows out from the reservoir tank 45, and flows into the engine cooling system through the outflow passage 46.

In the engine cooling system, during the period in which the thermostat valve 37 is closed, when the operation of the water pump 36 is stopped, the difference between the pressure in the area upstream of the thermostat valve 37 and the pressure in the area downstream of the thermostat valve 37 is small, and therefore, the jiggle valve 38 is open. Accordingly, a small amount of the coolant is permitted to flow through a route that extends from the radiator 32 to the water pump 36 through the circulation passage 34 and the jiggle valve 38. Thus, in the cooling apparatus according to the embodiment, during the period in which the thermostat valve 37 is closed, the coolant is permitted to flow from the reservoir tank 45 to the engine cooling system (more specifically, the upper portion of the radiator 32), because a small amount of the coolant is permitted to flow through the above-described route. That is, the flow of the coolant from the reservoir tank 45 to the engine cooling system is not interrupted by the thermostat valve 37.

In the embodiment, before the internal combustion engine 11 is started, the coolant in the reservoir tank 45 is forcibly introduced into the engine cooling system. In addition, the gas in the engine cooling system flows out to the reservoir tank 45, and thus, the gas is removed from the engine cooling system. Thus, the operation of the internal combustion engine 11 is started, and the cooling of the internal combustion engine 11 is started after the amount of the gas in the engine cooling system is reduced. Accordingly, it is possible to suppress a decrease in cooling performance due to the gas that has entered the engine cooling system.

Also, in the embodiment, it is possible to reduce the amount of the gas in the engine cooling system, without providing a discharge valve for discharging the gas, in the portion of the engine cooling system, where the gas is likely to accumulate. Thus, it is possible to reduce the possibility that the rotational shaft of the water pump 36 is seized in the bearing, by reducing the amount of the gas in the engine cooling system.

Further, in the embodiment, it is possible to reduce the amount of the gas in the engine cooling system, before the internal combustion engine 11 is started. Therefore, the amount of the gas in the engine cooling system is quickly reduced to an amount at which the cooling apparatus is able to provide sufficient cooling performance, as compared to a cooling apparatus where the amount of the gas in the engine cooling system is reduced after the internal combustion engine 11 is started. Accordingly, the amount of the gas in the engine cooling system at the time when the operation of the water pump 36 is started to cool the internal combustion engine 11 is reduced.

Figure 3:
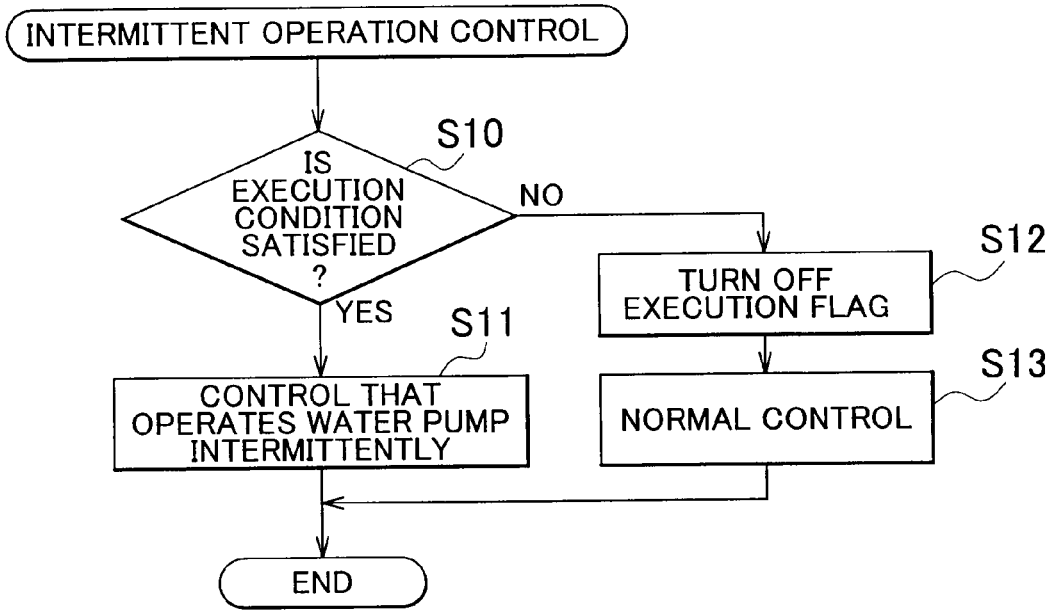
FIG. 3 is a flowchart showing processes of an intermittent operation control.

Hereinafter, a control executed to intermittently operate the water pump 36 (i.e., an intermittent operation control) will be described. FIG. 3 is a flowchart showing processes in the intermittent operation control. When the operation switch 22 is turned on, the electronic control unit 20 executes a series of the processes shown in the flowchart at predetermined time intervals.

As shown in FIG. 3, in the intermittent operation control, first, it is determined whether an execution condition for executing the control is satisfied (step S10). In this case, it is determined that the execution condition is satisfied, when both of a first condition that an execution flag is on, and a second condition that the coolant temperature THW is lower than a predetermined temperature (for example, 90 degrees) are satisfied. The execution flag is turned on, when the storage battery 16, which has not been connected to an electric circuit that supplies electric power to the internal combustion engine 11 and peripheral equipment for the internal combustion engine 11, is connected to the electric circuit.

When the execution condition is satisfied (YES in step S10), the internal combustion engine 11 is intermittently operated (step S11, and then, the control ends. In the embodiment, the processes in steps S10 and S11 may be regarded as the forcible introduction portion.

Figure 4:
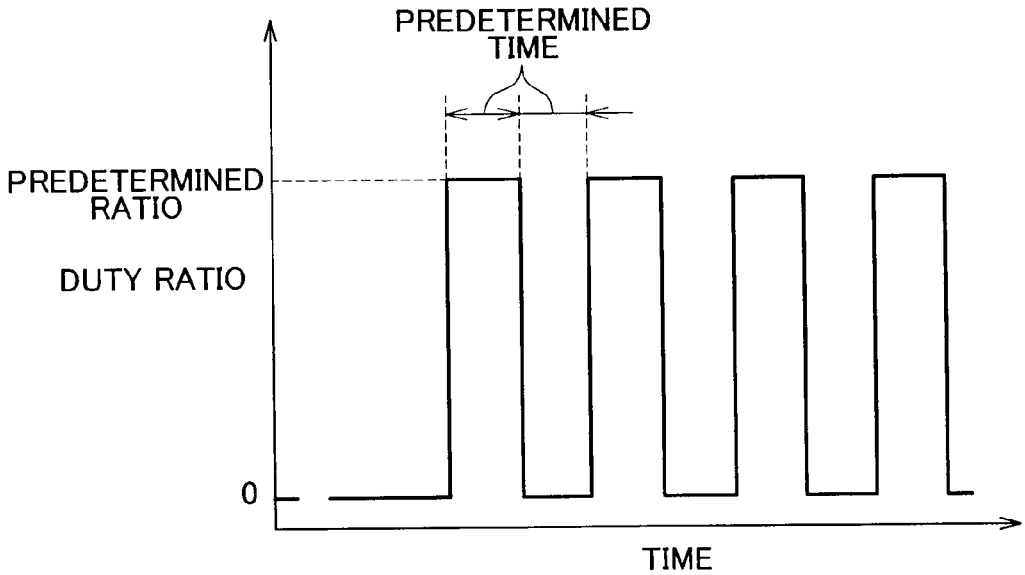
FIG. 4 is a time chart showing an example of a change in a duty ratio when a water pump is intermittently operated.

FIG. 4 shows an example of a change in the duty ratio when the water pump 36 is intermittently operated. More specifically, as shown in FIG. 4, when the water pump 36 is intermittently operated, the state of the water pump 36 is changed between an operated state (i.e., a state where the duty ratio is a predetermined ratio) and a stopped state (i.e., a state where the duty ratio is "0") at intervals of a predetermined time (at intervals of several hundred milliseconds to several seconds).

At this time, the gas that has entered the engine cooling system flows in the engine cooling system, without gathering in the location where the water pump 36 (FIG. 2) is disposed. Thus, the gas, which has reached the specific portion, flows into the reservoir tank 45 through the inflow passage 47. Accordingly, the coolant flows out from the reservoir tank 45, and flows into the engine cooling system through the outflow passage 46.

After the intermittent operation of the water pump 36 is started, the intermittent operation control is repeatedly executed. Then, when the coolant temperature THW becomes equal to or higher than the predetermined temperature, the execution condition is unsatisfied (i.e., NO in step S10 in FIG. 3). In this case, the execution flag is turned off (step S12), and the intermittent operation of the water pump 36 is stopped, and the above-described operation control of the water pump 36, which is executed at a normal operation time, is executed, that is, the normal control is executed (step S13). Then, the intermittent operation control ends, and thereafter, the normal control is executed as long as the execution flag is off.

In the cooling apparatus according to the embodiment, in the case where the internal combustion engine 11 (FIG. 1) is assembled or the coolant is changed, when the coolant is supplied into the engine cooling system, gas is likely to enter the engine cooling system, and the amount of the gas that enters the engine cooling system is likely to increase. The operation for supplying the coolant into the engine cooling system is generally performed while the electric circuit that supplies electric power to the internal combustion engine 11 and the peripheral equipment for the internal combustion engine 11 is disconnected from the storage battery 16 (more specifically, while a power source cable is disconnected from the terminal of the storage battery 16). Therefore, when the storage battery 16, which has been disconnected from the electric circuit that supplies the electric power to the internal combustion engine 11 and the peripheral equipment for the internal combustion engine 11, is connected to the electric circuit, there is a possibility that the operation for supplying the coolant into the engine cooling system has been performed. Thus, there is a possibility that the amount of the gas in the engine cooling system has increased.

In the embodiment, when the condition that the execution flag is on is satisfied, that is, when the storage battery 16, which has been disconnected from the electric circuit that supplies the electric power to the internal combustion engine 11 and the peripheral equipment for the internal combustion engine 11, is connected to the electric circuit, the water pump 36 is intermittently operated only once (refer to FIG. 3), in other words, the water pump 36 is intermittently operated only in a period until the execution condition becomes unsatisfied, i.e., the coolant temperature THW becomes equal to or higher than the predetermined temperature. Thus, the water pump 36 is intermittently operated only when there is a possibility that the operation for supplying the coolant into the engine cooling system has been performed. Thus, it is possible to efficiently reduce the amount of the gas in the engine cooling system.

The vehicle 10 is the hybrid vehicle. When the vehicle 10 is stopped, the vehicle 10 starts moving, or the vehicle 10 travels at a low speed, the operation of the internal combustion engine 11 is stopped. In contrast, in a vehicle in which only the internal combustion engine is provided as a power source, the internal combustion engine is constantly operated when the vehicle travels. Therefore, in the vehicle 10, a period from when the vehicle 10 is activated by turning on the operation switch 22 to when the internal combustion engine 11 is started tends to be long, as compared to the vehicle in which only the internal combustion engine is provided. Accordingly, it is possible to take a long time to forcibly introduce the coolant into the engine cooling system before the internal combustion engine 11 is started. Thus, according to the embodiment, it is possible to forcibly introduce the coolant into the engine cooling system for a long period before the internal combustion engine 11 is started. This makes it possible to sufficiently reduce the amount of the gas in the engine cooling system.

Figure 5:
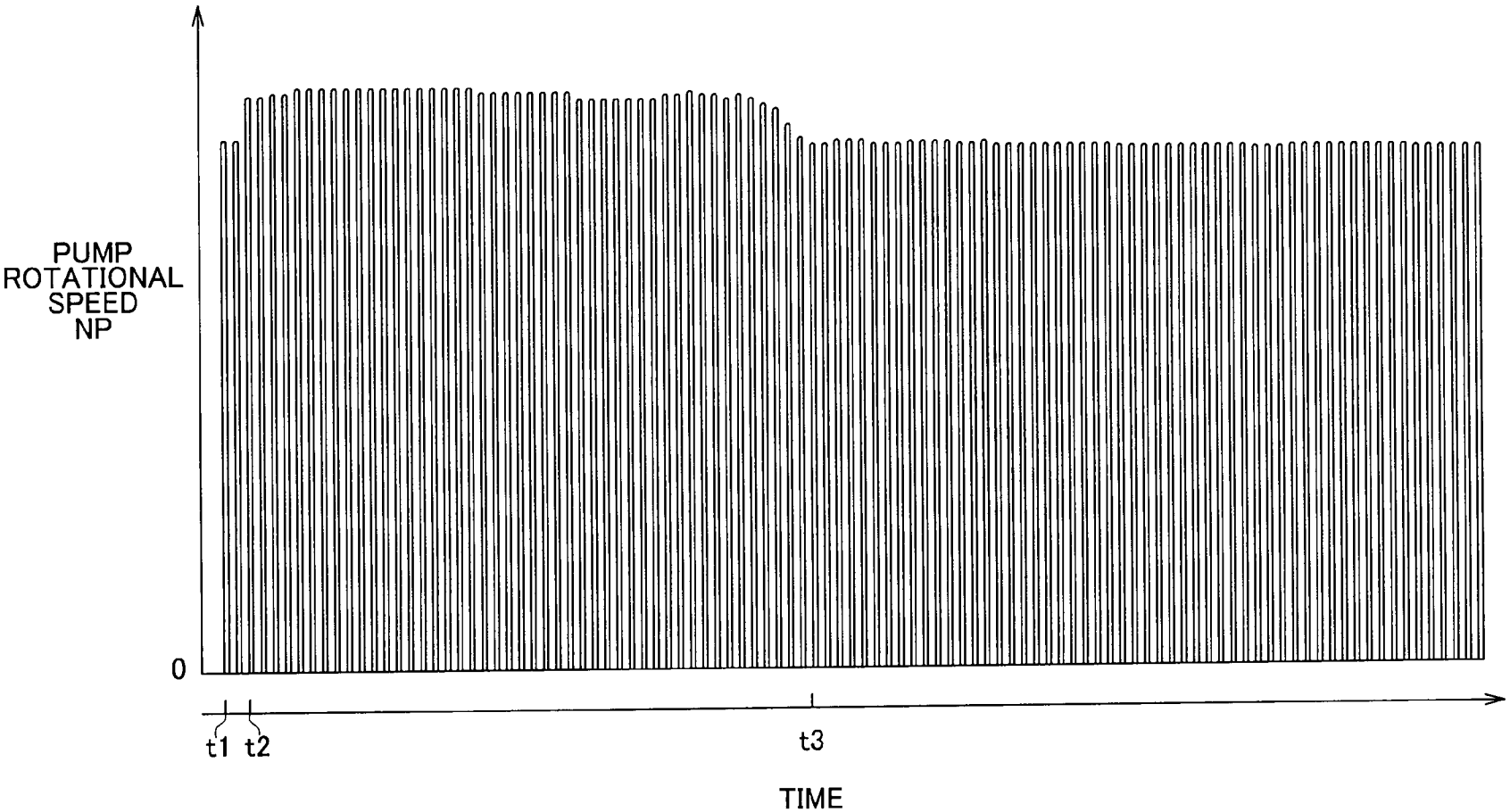
FIG. 5 is a time chart showing an example of a change in a pump rotational speed when the water pump is intermittently operated.

FIG. 5 shows an example of a change in the rotational speed of the output shaft of the water pump 36 (i.e., a pump rotational speed NP), when the water pump 36 is intermittently operated while there is air in the engine cooling system.

As shown in FIG. 5, when the execution condition is satisfied at time point t1, the intermittent operation of the water pump 36 is started. Then, the pump rotational speed NP slightly increases at time point t2. It is considered that the pump rotational speed NP slightly increases because part of the air in the engine cooling system gathers in the water pump 36 due to the operation of the water pump 36, and as a result, the load of the water pump 36 decreases, and therefore, the pump rotational speed NP increases.

The water pump 36 in this state continues to be intermittently operated. Then, at time point t3, the pump rotational speed NP decreases to a speed that is equal to a speed before the pump rotational speed NP increases at time point t2. It is considered that the gas flows from the engine cooling system into the reservoir tank 45 in the above-described manner, and thus, the gas is removed from the engine cooling system so that there is no gas in the water pump 36, and as a result, the load of the water pump 36 increases, and therefore, the pump rotational speed NP decreases.

Thus, in the cooling apparatus according to the embodiment, the gas, which has entered the engine cooling system, flows out to the reservoir tank 45, and thus, the gas is removed from the engine cooling system. Accordingly, the operation of the internal combustion engine 11 and the cooling of the internal combustion engine 11 using the coolant are started after the amount of the gas in the engine cooling system is reduced. This makes it possible to suppress a decrease in the cooling performance due to the gas that has entered the engine cooling system.

As described above, according to the embodiment, the following effects can be obtained. (1) Because the coolant is forcibly introduced from the reservoir tank 45 into the engine cooling system before the internal combustion engine 11 is started, the gas in the engine cooling system flows out to the reservoir tank 45, and thus, the gas is removed from the engine cooling system. Thus, the operation of the internal combustion engine 11 and the cooling of the internal combustion engine 11 using the coolant are started after the amount of the gas in the engine cooling system is reduced. This makes it possible to suppress a decrease in the cooling performance due to the gas that has entered the engine cooling system.

(2) The coolant is forcibly introduced from the reservoir tank 45 into the engine cooling system, by intermittently operating the water pump 36. Therefore, when the water pump 36 is operated, the gas mixed in the coolant moves to the intake side of the water pump 36 together with the coolant.

When the operation of the water pump 36 is stopped, the gas moves to the upper portion of the engine cooling system in the vertical direction due to the buoyant force. Accordingly, the gas flows in the engine cooling system, without gathering in the location where the water pump 36 is disposed. Thus, the gas in the engine cooling system moves to the specific portion that allows the gas to flow into the reservoir tank 45. As a result, it is possible to remove the gas from the engine cooling system.

(3) In the cooling apparatus where the amount of the gas mixed in the coolant in the engine cooling system is likely to be large because the detour 35 is provided, it is possible to reduce the amount of the gas in the engine cooling system. This makes it possible to suppress a decrease in the cooling performance due to the gas that has entered the engine cooling system.

(4) In the cooling apparatus where the amount of the gas mixed in the coolant in the engine cooling system is likely to be large because the heater core 39 of the heater unit is provided in the detour 35, it is possible to reduce the amount of the gas in the engine cooling system. This makes it possible to suppress a decrease in the cooling performance due to the gas that has entered the engine cooling system.

(5) During the period in which the thermostat valve 37 is closed, it is possible to allow the coolant to flow from the reservoir tank 45 to the engine cooling system, for example, by allowing the coolant to flow through the route that extends from the radiator 32 to the water pump 36 through the circulation passage 34 and the jiggle valve 38. That is, the flow of the coolant from the reservoir tank 45 to the engine cooling system is not interrupted by the thermostat valve 37.

(6) Because the vehicle 10 is the hybrid vehicle, the period from when the vehicle 10 is activated until when the internal combustion engine 11 is started tends to be long in the vehicle 10, as compared to the vehicle in which only the internal combustion engine is provided. Accordingly, it is possible to take a long time to forcibly introduce the coolant into the engine cooling system before the internal combustion engine 11 is started. Thus, according to the embodiment, it is possible to forcibly introduce the coolant into the engine cooling system for a long period before the internal combustion engine 11 is started. This makes it possible to sufficiently reduce the amount of the gas in the engine cooling system.

(7) Each time the storage battery 16, which has been disconnected from the electric circuit that supplies the electric power to the internal combustion engine 11 and the peripheral equipment for the internal combustion engine 11, is connected to the electric circuit, the water pump 36 is intermittently operated only once, in other words, the water pump 36 is intermittently operated only in the period until the execution condition becomes unsatisfied, i.e., the coolant temperature THW becomes equal to or higher than the predetermined temperature. Therefore, the water pump 36 is intermittently operated to reduce the amount of the gas in the engine cooling system only when there is a possibility that the operation for supplying the coolant into the engine cooling system has been performed. Thus, it is possible to efficiently reduce the amount of the gas in the engine cooling system, and accordingly, to appropriately suppress a decrease in the cooling performance.

First Modified Example of the Embodiment

Hereinafter, a cooling apparatus for an internal combustion engine according to a first modified example of the embodiment of the invention will be described. The first modified example of the embodiment is the same as the embodiment, except that the water pump 36 is intermittently operated before the start of the internal combustion engine 11 each time the vehicle 10 is activated by turning on the operation switch 22 in the first modified example of the embodiment. More specifically, in the first modified example of the embodiment, the execution condition includes a first condition that the vehicle 10 is activated, and a second condition that the coolant temperature THW is lower than the predetermined temperature. When both of the conditions are satisfied, the intermittent operation of the water pump 36 is started. When the second condition is unsatisfied, the intermittent operation of the water pump 36 is stopped.

Second Modified Example of the Embodiment

Hereinafter, a cooling apparatus for an internal combustion engine according to a second modified example of the embodiment of the invention will be described. The second modified example of the embodiment is the same as the embodiment, except that the water pump 36 is intermittently operated during a period before the operation switch 22 is turned on in the second modified example of the embodiment. More specifically, in the second modified example of the embodiment, the execution condition includes a first condition that an operation for opening a door of the vehicle is performed, and a second condition that the coolant temperature THW is lower than the predetermined temperature. When both of the conditions are satisfied, the intermittent operation of the water pump 36 is started. When the second condition is unsatisfied, the intermittent operation of the water pump 36 is stopped. In this configuration, it is possible to advance the timing at which the intermittent operation of the water pump 36 is started. For example, the intermittent operation of the water pump 36 may be started at a timing at which the driver operates a keyless entry system to open the door, or a timing at which the driver touches a door handle. Thus, it is possible to more quickly reduce the amount of the gas in the engine cooling system.

In the above-described embodiment and the modified examples of the embodiment, the following modifications may be made. The thermostat valve 37 in which the jiggle valve 38 is provided need not necessarily be employed. A thermostat valve in which a small through-hole is formed may be employed, as the thermostat valve 37. In this configuration as well, during the period in which the thermostat valve 37 is closed, it is possible to allow the coolant to flow from the reservoir tank 45 to the engine cooling system, for example, by allowing the coolant to flow through the route that extends from the radiator 32 to the water pump 36 through the circulation passage 34 and the through-hole.

Instead of the condition that "the coolant temperature THW is lower than the predetermined temperature" in the execution condition, the condition that "a time period during which the water pump 36 is intermittently operated is shorter than a predetermined time period", the condition that "an elapsed time after the vehicle 10 is activated is shorter than a predetermined time", the condition that "the pressure of the coolant in the engine cooling system is lower than a predetermined pressure" may be set. In other words, any condition may be set as one condition in the execution condition, as long as it is possible to appropriately determine whether the amount of the gas in the engine cooling system is sufficiently reduced even when the gas has entered the engine cooling system, based on the condition.

To alternately change the state of the engine cooling system between a state where the coolant is circulated and a state where the circulation of the coolant is stopped, a switching valve, which permits and prohibits the circulation of the coolant in the engine cooling system, may be additionally provided, and the water pump 36 may be continuously operated while the switching valve is intermittently opened, instead of intermittently operating the water pump 36.

The water pump 36 may be operated to circulate the coolant in a manner such that the state of the engine cooling system is alternately changed between a state where a relatively large amount of the coolant is circulated and a state where the amount of the circulated coolant is extremely small. In other words, the coolant may be circulated by operating the water pump 36 in a manner such that the amount of the coolant circulated in the engine cooling system is repeatedly increased and decreased. In this configuration, when the amount of the circulated coolant is large, the gas mixed in the coolant moves to the intake side of the water pump 36 together with the coolant. When the amount of the circulated coolant is small, the gas moves to the upper portion of the engine cooling system in the vertical direction due to the buoyant force. Thus, the gas flows in the engine cooling system without gathering in the location where the water pump 36 is disposed.

The above-described embodiment and the modified examples of the embodiment may be applied to a cooling apparatus where the heater core 39, the exhaust heat recovery unit 40, the EGR cooler 41, and the throttle passage 42 are not provided. Also, the above-described embodiment may be applied to a cooling apparatus where the detour 35 is not provided.

The invention may be applied to a vehicle in which only the internal combustion engine is provided as a power source.

While the invention has been described with reference to example embodiments thereof, it is to be understood that the invention is not limited to the described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the spirit and scope of the invention.

What is claimed is:

1. A cooling apparatus for an internal combustion engine, comprising:

an engine cooling system that includes a water jacket, a radiator, and a circulation passage through which a coolant is circulated between the water jacket and the radiator, wherein the coolant is provided in the engine cooling system;

a water pump that forcibly circulates the coolant provided in the engine cooling system when the water pump is operated;

a reservoir tank in which the coolant is reserved, and into which gas flows from the engine cooling system while the reserved coolant flows out from the reservoir tank to the water jacket via the radiator; and a control unit programmed to intermittently operate the water pump by controlling the water pump between an operating state and an off state at intervals of a predetermined time to forcibly introduce the coolant from the reservoir tank into the engine cooling system before the internal combustion engine is started, wherein the reservoir tank is connected to the radiator through an outflow passage and is connected to the water jacket through an inflow passage.

2. The cooling apparatus according to claim 1, wherein:

when the gas reaches a specific portion of the engine cooling system, the gas flows into the reservoir tank while the coolant flows out from the reservoir tank; and the control unit is programmed to operate the water pump in a manner such that an amount of the coolant circulated in the engine cooling system is increased and decreased.

3. The cooling apparatus according to claim 2, wherein the water pump is an electric water pump.

4. The cooling apparatus according to claim 3, wherein:

when a storage battery, which has been disconnected from an electric circuit that supplies electric power to the internal combustion engine and peripheral equipment for the internal combustion engine, is connected to the electric circuit, and a temperature of the coolant is lower than a predetermined temperature, the control unit starts intermittent operation of the water pump; and when the temperature of the coolant is equal to or higher than the predetermined temperature, the control unit stops the intermittent operation of the water pump.

5. The cooling apparatus according to claim 1, wherein the engine cooling system further includes a detour which bypasses the radiator, and through which the coolant in the circulation passage is returned into the water jacket.

6. The cooling apparatus according to claim 5, wherein a heater core of a heater unit is provided in the detour.

7. The cooling apparatus according to claim 5, further comprising:

a thermostat valve provided in the circulation passage, wherein when a temperature of the coolant that contacts the thermostat valve is lower than a threshold value, the thermostat valve is closed to prohibit the coolant from flowing into the radiator, and when the temperature of the coolant that contacts the thermostat valve is equal to or higher than the threshold value, the thermostat valve is opened to permit the coolant to flow into the radiator; and a jiggle valve provided in the thermostat valve, wherein:

the detour bypasses the thermostat valve; and the reservoir tank is disposed in a manner such that the coolant, which flows out from the reservoir tank, flows into the water pump through the thermostat valve.

8. The cooling apparatus according to claim 1, wherein the control unit is programmed to operate the water pump to forcibly introduce the coolant into the engine cooling system only once, each time a storage battery, which has been disconnected from an electric circuit that supplies electric power to the internal combustion engine and peripheral equipment for the internal combustion engine, is connected to the electric circuit.

9. A hybrid vehicle including the internal combustion engine and a motor that function as power sources, comprising the cooling apparatus according to claim 1.

10. The hybrid vehicle according to claim 9, wherein the control unit is programmed to operate the water pump to forcibly introduce the coolant into the engine cooling system, each time the hybrid vehicle is activated.

11. The hybrid vehicle according to claim 9, wherein the control unit is programmed to operate the water pump to forcibly introduce the coolant into the engine cooling system, each time an operation for opening a door of the hybrid vehicle is performed.

12. A method of controlling a cooling apparatus for an internal combustion engine, the cooling apparatus including an engine cooling system that includes a water jacket, a radiator, and a circulation passage through which a coolant is circulated between the water jacket and the radiator, wherein the coolant is provided in the engine cooling system; a water pump that forcibly circulates the coolant provided in the engine cooling system when the water pump is operated; and a reservoir tank in which the coolant is reserved, and into which gas flows from the engine cooling system while the reserved coolant flows out from the reservoir tank to the water jacket via the radiator, the method comprising:

determining whether a predetermined condition is satisfied before the internal combustion engine is started;

starting intermittent operation of the water pump to forcibly introduce the coolant from the reservoir tank into the engine cooling system by controlling the water pump between an operating state and an off state at intervals of a predetermined time, when the predetermined condition is satisfied; and stopping the intermittent operation of the water pump, when the predetermined condition is unsatisfied.

13. The method according to claim 12, wherein:

the predetermined condition includes a first condition that a storage battery, which has been disconnected from an electric circuit that supplies electric power to the internal combustion engine and peripheral equipment for the internal combustion engine, is connected to the electric circuit, and a second condition that a temperature of the coolant is lower than a predetermined temperature; and when both of the first condition and the second condition are satisfied, the intermittent operation of the water pump is started; and when the second condition is unsatisfied, the intermittent operation of the water pump is stopped.

14. The method according to claim 12, wherein:

the cooling apparatus is provided in a vehicle;

the predetermined condition includes a first condition that an operation for opening a door of the vehicle is performed, and a second condition that a temperature of the coolant is lower than a predetermined temperature; and when both of the first condition and the second condition are satisfied, the intermittent operation of the water pump is started; and when the second condition is unsatisfied, the intermittent operation of the water pump is stopped.

15. The method according to claim 12, wherein:

the cooling apparatus is provided in a hybrid vehicle including the internal combustion engine and a motor that function as power sources;

the predetermined condition includes a first condition that the hybrid vehicle is activated, and a second condition that a temperature of the coolant is lower than a predetermined temperature; and when both of the first condition and the second condition are satisfied, the intermittent operation of the water pump is started; and when the second condition is unsatisfied, the intermittent operation of the water pump is stopped.

16. The method according to claim 12, wherein the predetermined time is at least 200 milliseconds.

17. The method according to claim 12, wherein the reservoir tank is connected to the radiator through an outflow passage and is connected to the water jacket through an inflow passage.

18. A cooling apparatus for an internal combustion engine, comprising:

an engine cooling system that includes a water jacket, a radiator, and a circulation passage through which a coolant is circulated between the water jacket and the radiator, wherein the coolant is provided in the engine cooling system;

a water pump that forcibly circulates the coolant provided in the engine cooling system when the water pump is operated;

a reservoir tank in which the coolant is reserved, and into which gas flows from the engine cooling system while the reserved coolant flows out from the reservoir tank to the water jacket via the radiator; and a control unit programmed to intermittently operate the water pump by controlling the water pump between an operating state and an off state at intervals of a predetermined time to forcibly introduce the coolant from the reservoir tank into the engine cooling system before the internal combustion engine is started, wherein the predetermined time is at least 200 milliseconds.

* * * * *